US005445193A

United States Patent [19]

Koeninger et al.

[11] Patent Number: 5,445,193

[45] Date of Patent: Aug. 29, 1995

[54] APPARATUS FOR PREPARING AND DISPENSING LIQUIDS FOR THE TREATMENT OF PHOTOSENSITIVE MATERIAL

[75] Inventors: Horst Koeninger, Munich; Walter Kohlbauer, Kaufbeuren, both of Germany

[73] Assignee: AGFA-Gevaert Aktiengesellschaft, Leverkusen, Germany

[21] Appl. No.: 29,120

[22] Filed: Mar. 10, 1993

[30] Foreign Application Priority Data

Apr. 1, 1992 [DE] Germany ..... 42 10 794.6

[51] Int. Cl.[6] ..... B65B 3/04

[52] U.S. Cl. ..... 141/18; 366/136; 141/9; 141/198; 141/83; 141/104

[58] Field of Search ..... 141/9, 69, 83, 94, 102, 141/104, 105, 198, 35; 366/136, 137, 280, 132

[56] References Cited

U.S. PATENT DOCUMENTS

| | | | |
|---|---|---|---|
| 3,653,414 | 4/1972 | Weidner | 141/9 X |
| 4,673,008 | 6/1987 | McDermott | 141/198 |
| 4,764,019 | 8/1988 | Kaminski et al. | 366/136 X |
| 4,857,355 | 8/1989 | Gregg | 366/136 X |
| 5,137,694 | 8/1992 | Copeland | 366/136 X |
| 5,156,197 | 10/1992 | Baruffato et al. | 191/9 X |
| 5,207,251 | 5/1993 | Cooks | 141/83 |

*Primary Examiner*—Ernest G. Cusick
*Attorney, Agent, or Firm*—Darby & Darby

[57] ABSTRACT

Apparatus for the preparation and dispensing of liquids which are used in developing machines for photosensitive material has a vessel with an upright partition over which a freshly formed mixture containing at least one liquid substance can overflow from a mixing chamber into a storage chamber. The latter has a bottom wall disposed at a level below the bottom wall of the mixing chamber and provided with an outlet which discharges mixture into a collecting container. A pump is provided to circulate the liquid substance along an endless path extending in part through the mixing chamber, and the partition has an opening slightly above or at the level of the bottom wall of the mixing chamber to permit direct flow of mixture between the two chambers when the mixture in the storage chamber reaches a certain level. The flow of mixture through the opening is controlled by a valve including a float.

14 Claims, 2 Drawing Sheets

APPARATUS FOR PREPARING AND DISPENSING LIQUIDS FOR THE TREATMENT OF PHOTOSENSITIVE MATERIAL

BACKGROUND OF THE INVENTION

The invention relates to improvements in apparatus for preparing and dispensing liquids which are used for the treatment of photosensitive materials. More particularly, the invention relates to improvements in apparatus which can be utilized to mix water or another liquid substance with at least one second substance (such as a liquid and/or a solid material which is dispersible or soluble in water or in another liquid substance) to form a mixture for the processing of exposed but undeveloped photographic films and/or for the processing of exposed but undeveloped photographic paper in a photographic processing laboratory.

If a processing laboratory is designed to consume large quantities of liquid developing materials, it is customary to supply various chemicals in highly concentrated form and to make the bath or baths (such as a developing, mixing or rinsing bath) at the locus of actual use. In many instances, chemicals which are supplied in solid form must be mixed with water to form therewith mixtures, solutions or dispersions (hereinafter called mixtures) which are ready to treat exposed but undeveloped photographic films, webs or sheets of photographic paper and/or other photosensitive materials. The concentrated substances which are to be mixed with water or with another liquid substance can be supplied in solid form (e.g., in a granular or pulverulent state) or in the form of liquids which are to be mixed with, dispersed in or dissolved in water or in another liquid substance. To this end, the photographic processing laboratories are equipped with special mixing apparatus which are designed to prepare liquids ready to contact webs, sheets, strips or other forms of photosensitive material. For example, certain known apparatus are designed to supply a mixture to one or more tanks for developing, fixing or other liquids in such a way that the respective tank or tanks receive regenerating mixtures without any interruptions as long as the developing machine is on.

In accordance with a presently known proposal, a mixing apparatus of the above outlined character is equipped with a mixing tank and a discrete storage or buffer tank. The storage tank is installed at a level below and is connected with the mixing tank. The connection is controlled by a magnetic valve in such a way that a fresh supply of mixture of water with one or more solid and/or liquid substances is caused or permitted to flow from the mixing tank into the storage tank as soon as a mixing operation in the mixing tank is completed. The valve then opens and a portion of the freshly obtained mixture is transferred into the storage tank. The latter continuously supplies the mixture to the developing machine proper, and the supply of mixture therein is continuously replenished through the magnetic valve. When the mixing tank is empty (i.e., when only the storage tank still contains a certain quantity of mixture), the magnetic valve is closed and the preparation of a fresh supply of mixture in the mixing tank is ready to take place.

Certain mixing apparatus of the above outlined character are provided with a horizontal partition which divides a vessel into a mixing tank and a storage tank, with the storage tank located at a level below and the mixing tank located at a level above the horizontal partition. The magnetic valve is designed to control the flow of mixture from the mixing tank, through an opening in the horizontal partition, and into the storage tank. Thus, the magnetic valve is in continuous contact with and is likely to be contaminated or clogged by certain constituents of the mixture, e.g., by non-dissolved solid granular and/or pulverulent particles which were to be admixed to and dissolved in water in the course of a mixing operation. This results in repeated stoppages of the apparatus and of the entire processing laboratory. Another drawback of such apparatus is that the storage tank is completely enclosed, i.e., that its interior is not accessible without at least partial dismantling of the apparatus. On the other hand, convenient access to the interior of the storage tank is desirable and advantageous, e.g., for evacuation of gathered sediments at regular or irregular intervals.

Attempts to overcome the drawbacks of the aforedescribed apparatus include the provision of two separate vessels, one of which constitutes a mixing tank and the other of which constitutes a storage tank. The two tanks are connected to each other by a hose, and the flow of mixture in the hose from the mixing tank to the storage tank is controlled by a magnetic valve. Such apparatus are rather expensive and their space requirements are much greater than those of apparatus wherein the mixing tank and the storage tank constitute portions of a single container.

OBJECTS OF THE INVENTION

An object of the invention is to provide a combined mixture preparing and dispensing apparatus which embodies the advantages but does not share the drawbacks of heretofore known apparatus.

Another object of the invention is to provide novel and improved connections between the parts of the improved apparatus.

A further object of the invention is to provide an apparatus which can be installed in existing developing machines as a superior substitute for heretofore known combined mixing and dispensing apparatus.

An additional object of the invention is to provide the apparatus with novel and improved means for preparing the mixture for admission into storage.

Still another object of the invention is to provide a novel and improved method of preparing a mixture of one or more liquids and/or one or more liquids and one or more solids in an apparatus of the above outlined character.

A further object of the invention is to provide an apparatus which need not be equipped with expensive valves and wherein the deposition of undissolved or undispersed solids is less likely than in heretofore known apparatus.

Another object of the invention is to provide an apparatus wherein the making and/or processing of mixtures can be automated to any desired extent.

An additional object of the invention is to provide the apparatus with a novel and improved vessel for the mixing and storage of flowable agents which are to be used in developing machines for photosensitive materials.

Still another object of the invention is to provide a novel and improved system for circulating the contents of that portion of the vessel wherein two or more substances are mixed preparatory to admission of the resulting mixture into a developing or fixing tank in a photographic processing laboratory.

A further object of the invention is to provide the apparatus with novel and improved means for maintaining a requisite supply of mixture in a state of readiness for admission into a developing machine.

Another object of the invention is to provide a simple and inexpensive apparatus which is or which can be assembled of rugged and readily available components.

An additional object of the invention is to provide an apparatus which requires less attention, particularly less maintenance, than heretofore known apparatus.

SUMMARY OF THE INVENTION

The invention is embodied in an apparatus for preparing and dispensing a liquid for the treatment of photosensitive materials, e.g., for preparing and dispensing a developing solution for unexposed but developed strips, webs or sheets of photographic film, photographic paper or the like. The improved apparatus comprises a mixing chamber or tank including means for making a mixture of at least one liquid substance with at least one second (liquid and/or solid) substance, and a storage chamber or tank adjacent the mixing chamber and having an outlet for the mixture of the aforementioned substances. The two chambers define a first path for the overflow of mixture from the mixing chamber into the storage chamber when the mixture in the mixing chamber rises to a first predetermined level, and the apparatus further comprises a valve having means for establishing a second path for the flow of the mixture between the two chambers when the mixture in the storage chamber reaches a predetermined level, for example, for permitting the mixture to flow from the mixing chamber into the storage chamber when the supply of mixture in the storage chamber descends or rises to the second level.

The apparatus is or can be designed to continuously dispense a liquid for the treatment of photosensitive materials. The chambers or tanks can include a common partition having a top portion at the first level, i.e., the mixture can overflow from the mixing chamber into the storage chamber when the supply of mixture in the mixing chamber rises above the first level, namely above the top portion of the partition.

The valve can be a relatively simple and inexpensive valve. In accordance with a presently preferred embodiment, the valve comprises a float in the storage chamber and a valving element (e.g., a flap) which is movable by the float to expose or seal one or more openings in the aforementioned partition below the top portion of the partition to thus establish the second path (through the opening or openings) when the mixture in the storage chamber descends to or below the second level.

The chambers can form part of a single vessel having an internal partition which is disposed between the mixing and storage chambers and defines the first path by permitting the mixture to flow over its top portion from the mixing chamber into the storage chamber when the supply of mixture in the mixing chamber reaches or exceeds the first level.

The mixing chamber can include a bottom wall in the region of (e.g., at or slightly below) the second level.

The apparatus preferably further comprises means for delivering to the mixing chamber a metered quantity of at least one liquid substance when the mixture in the mixing chamber descends below the second level. The storage chamber preferably includes a portion which is disposed below the second level and has a capacity which at least suffices to store a quantity of mixture at least matching the predetermined quantity.

The mixture making means can include means for circulating the mixture along a third path having an inlet which is disposed in the mixing chamber at a level above the bottom wall of the mixing chamber. The circulating means can comprise a pump, and the delivering means can be provided with an outlet disposed in the mixing chamber above the second level and close to the bottom wall of the mixing chamber. The delivering means of such apparatus can comprise means (e.g., a pipe extending downwardly into the mixing chamber) for supplying to the mixing chamber the at least one liquid substance at a location adjacent the inlet, particularly above and at least substantially in line with the inlet of the third path.

The bottom wall of the storage chamber can be disposed above a mixture collecting container, and the outlet of the storage chamber can be provided in such bottom wall.

The bottom walls of the mixing and storage chambers are or can be disposed at different levels. It is presently preferred to locate the bottom wall of the mixing chamber at a level above the bottom wall of the storage chamber.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
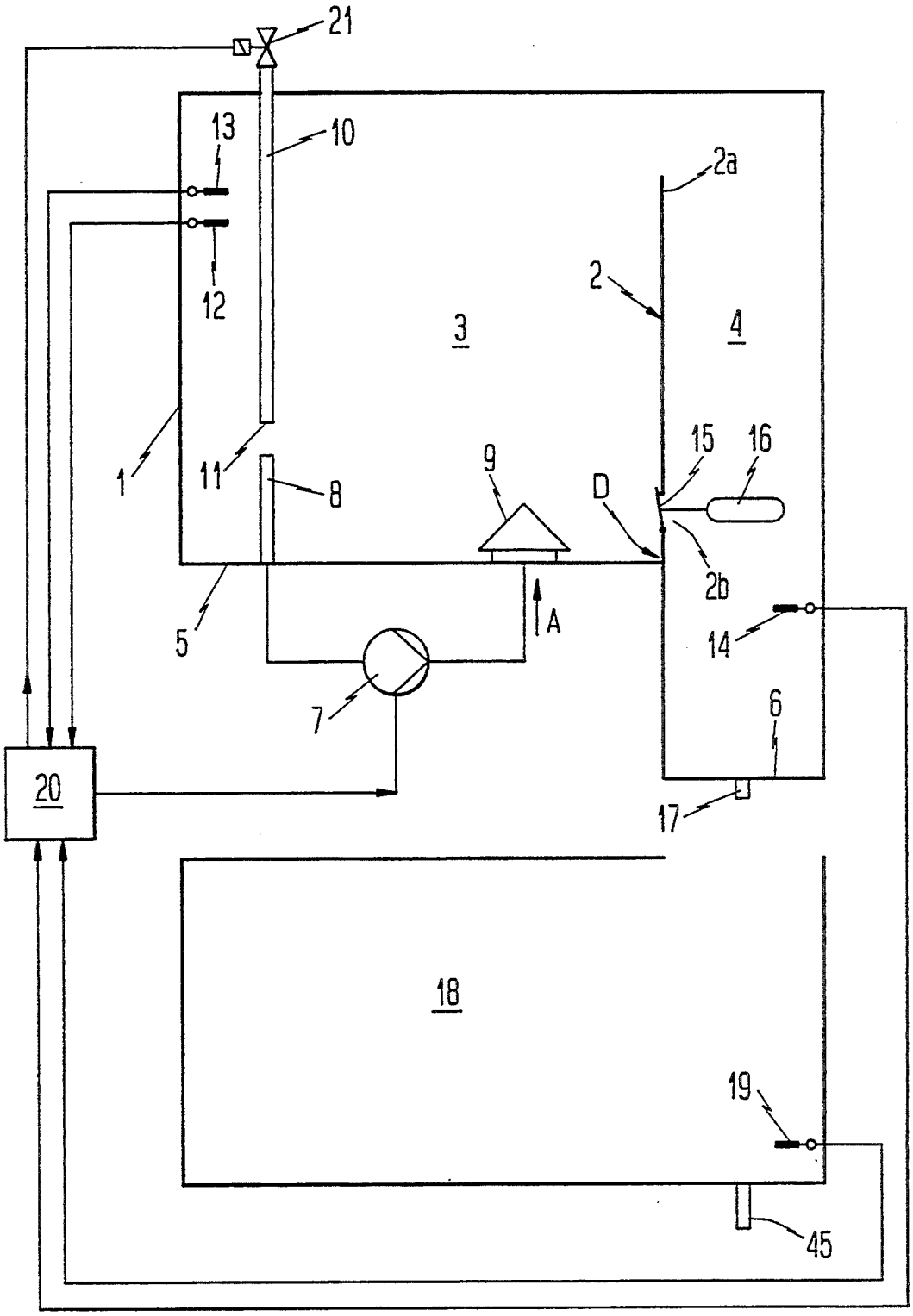
FIG. 1 is a schematic partly elevational and partly vertical sectional view of an apparatus which embodies one form of the invention and wherein the second path between the mixing and storage chambers is sealed because the upper surface of the supply of mixture in the storage chamber is assumed to be located above the second level.

FIG. 1 shows an apparatus wherein a vessel 1 comprises a mixing tank or chamber 3 and a storage tank or chamber 4. The two chambers have a common upright partition 2 including a top portion 2*a* which permits a mixture to overflow from the interior of the chamber 3 into the interior of the chamber 4 when the upper surface of such mixture rises to or above the level of the top portion 2*a*. The bottom wall 5 of the mixing chamber 3 is located at a level above the bottom wall 6 of the storage chamber 4, and the bottom wall 6 has an outlet 17 which is located above a relatively large mixture collecting container 18.

The means for making a mixture in the chamber 3 includes a pump 7 which serves to circulate the mixture or at least a liquid substance or fraction (such as water) of the mixture along a substantially endless path having an inlet 8 in the chamber 3 at a certain level above the bottom wall 5 and below an outlet 11 for delivery of water. The inlet 8 of the endless or practically endless path for circulation of the mixture or water is constituted by the upper end portion of a pipe extending downwardly through the bottom wall 5 and serving to supply mixture or water to the pump 7. The outlet of the pump 7 is connected to a conduit 32 (FIG. 2*a*) forming part of a specially designed nozzle 9 which admits the mixture or water into the chamber 3 directly above or at least close to the bottom wall 5 when the pump 7 is in operation. The outlet 11 constitutes the lower end of an upright conduit 10 serving to deliver the liquid substance (e.g., water) of the mixture from a source (e.g., a water tank or a faucet) in response to opening of a flow regulating valve 21.

The mixing chamber 3 confines a first sensor 12 which transmits a first signal when the supply of mixture in the chamber 3 rises to its level, and a second sensor 13 at a level somewhat above that of the sensor 12 to transmit a second signal when contacted by the mixture in the chamber 3. The purpose of the sensors 12, 13 is to facilitate the selection of proper ratios of various substances which are to form the mixture in the chamber 3.

A third sensor 14 is installed in the storage chamber 4 at a level somewhat below the bottom wall 5 of the mixing chamber 3 but still rather well above the bottom wall 6 for the outlet 17. A relatively simple valve in the storage chamber 4 includes a valving element or flap 15 which is pivotable and/or otherwise movable by a float 16 when the upper surface of the supply of mixture in the tank 4 reaches a level well below the level of the top portion 2*a* of the partition 2 whereby the flap 15 exposes an opening 2*b* which is provided in the partition in the region of the bottom wall 5. In the illustrated apparatus, the opening 2*b* is located above the bottom wall 5 but well below the top portion 2*a* of the partition 2.

A fourth sensor 19 is installed in the lower portion of the container 18 which is provided with an outlet 45. Signals from the sensors 12, 13, 14 and 19 are transmitted to the corresponding inputs of a signal evaluating and processing circuit 20 having two outputs, one for transmission of signals to the motor for the pump 7 and the other for transmission of signals to the flow regulating valve 21.

Figure 2A:
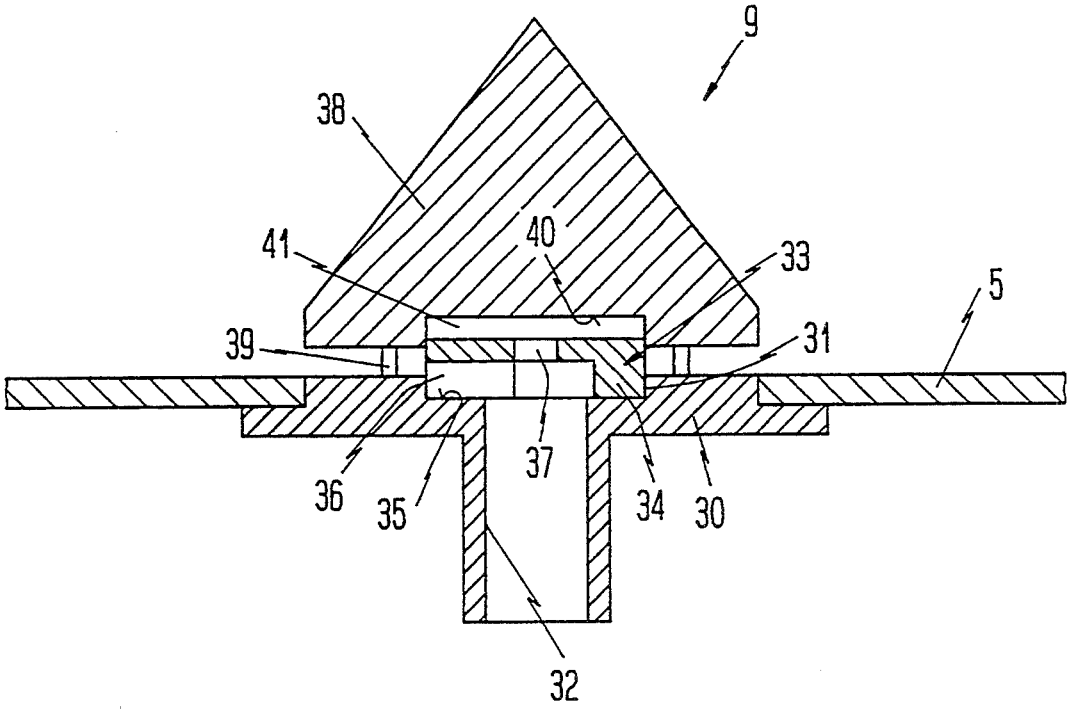
FIG. 2*a* is an enlarged central vertical sectional view of a portion of means for mixing two or more substances in the mixing chamber of the apparatus which is shown in FIG. 1.
Figure 2B:
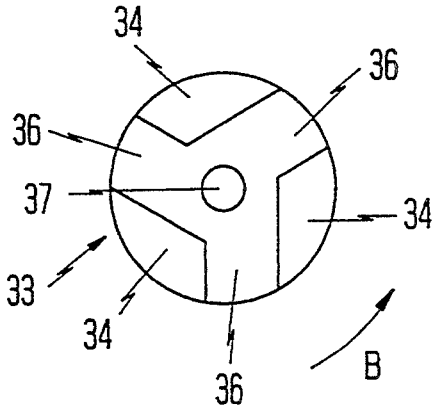
FIG. 2*b* is a bottom plan view of a component in the mixing means of FIG. 2*a*.

The details of a presently preferred mixing nozzle 9 are shown in FIGS. 2*a* and 2*b*. This nozzle comprises a collar 30 which is or which can be of one piece with the aforementioned conduit 32 and is sealingly installed in the bottom wall 5 of the mixing chamber or tank 3. The collar 30 can be said to constitute a base plate of the mixing nozzle 9 and its upper side is provided with a recess 31 which is concentric with the passage of the conduit 32 and receives, with minimal play, a substantially flat disc-shaped rotor 33 (see also FIG. 2*b*). The underside of the rotor 33 has three circumferentially spaced apart raised portions 34 which abut the surface 35 at the bottom of the recess 31 and alternate with substantially radially extending channels 36 serving to receive mixture or water from the conduit 32 and, due to their (substantially star-shaped) distribution and configuration (as best shown in FIG. 2*b*) causing the rotor 33 to turn when the pump 7 is driven to deliver pressurized mixture into the conduit 32.

A conical upper portion or cap 38 of the nozzle 9 overlies a central vertical passage 37 in the rotor 33 and is secured to the collar 31 by a set of vertical pins 39. A circular recess 40 in the underside of the cap 38 serves to receive, with relatively small clearance, the upper portion of the rotor 33. A flat compartment 41 is shown between the upper side of the rotor 33 and the surface at the bottom of the recess 40.

If the pump 7 is started in response to a signal from the circuit 20, it delivers pressurized mixture or water in the direction of arrow A, i.e., into the conduit 32 whence the mixture flows into the passage 37 as well as into the channels 36. The pressurized mixture lifts the rotor 33 into the recess 40 while the compartment 41 receives pressurized mixture through the central passage 37. The mixture which flows radially outwardly through the channels 36 causes the rotor 33 to turn in the direction of arrow B (FIG. 2*b*) so that jets of mixture or water issuing from the channels 36 sweep along the upper side of the bottom wall 5 and not only promote the mixing action but also reduce the likelihood of accumulation of solid substances on the bottom wall 5. When the pressures in the nozzle 9 are equalized or balanced, a first friction-reducing liquid film develops adjacent the upper side of the rotor 33 (in the recess 40) and a second friction-reducing liquid film develops in the recess 31 adjacent the surface 35 (i.e., at the underside of the driven rotor 33). The number of channels 36 can be increased above or reduced to less than three without departing from the spirit of the invention.

The mode of operation of the apparatus which is shown in FIG. 1 is as follows:

If the upper surface of the supply of mixture in the storage chamber or tank 4 descends below the level of the sensor 14, the latter transmits a signal to the circuit 20 which causes the regulating valve 21 to open so that the conduit 10 delivers a liquid substance (such as water) into the mixing chamber or tank 3. The valve 21 remains open until the supply of liquid in the mixing chamber 3 rises to the level of the sensor 12. The latter transmits to the circuit 20 a signal which causes the circuit 20 to shut the regulating valve 21. At the same time, the circuit 20 generates a visible, audible and/or otherwise detectable signal (e.g., on a screen serving to display the signal to an operator) which informs the person or persons in charge that a mixing operation should take place. Such person or persons can admit a solid (e.g., granular or pulverulent) substance through the open top of the mixing chamber 3, either by hand or by resorting to a suitable metering device (not shown), and the admission of such substance is terminated when the level of the thus obtained mixture in the chamber 3 rises to that of the sensor 13. The latter transmits a signal which induces the circuit 20 to start the pump 7 so that a first stage of the actual mixing operation begins. The inlet 8 draws mixture from the chamber 3 and such mixture is conveyed by the pump 7 to enter the conduit 32 in the direction of arrow A and to be sprayed by the driven rotor 33 in the form of three jets along the upper side of the bottom wall 5. The solid substance or substances cannot settle on the bottom wall 5 and are agitated by the orbiting jets which issue from the channels 36 of the rotor 33 to thus promote their dispersion and preferably rather gradual dissolution in water which was supplied by the conduit 10.

The pump 7 is arrested in response to a signal from the circuit 20 after an interval of time, e.g., an interval which can suffice to ensure that the mixture in the chamber 3 is satisfactory for use in a developing machine. The next signal is generated by the sensor 19 when the supply of mixture in the container 18 drops to the level of the sensor 19. This ensures that the unoccupied portion of the container 18 can receive the freshly formed supply of mixture. A signal from the sensor 19 causes the circuit 20 to open the valve 21 and to start the pump 7. Since the outlet 11 of the conduit 10 is located close to, above and in line with the inlet 8, the pump 7 merely or primarily draws water which is delivered by the conduit 10, and such water is admitted into and mixes with the contents of the chamber 3. In other words, at least the major part of water which is supplied in response to opening of the valve 21 (i.e., in response to a signal from the sensor 19) is caused or permitted to mix with the contents of the mixing chamber 3 only after it has passed through the conduit 32 and has reentered the chamber 3 through the channels 36 of the rotor 33 in the nozzle 9. The level of mixture in the chamber 3 rises while the conduit 10 delivers additional water in response to a signal from the sensor 19, and the supply of mixture in the chamber 3 rapidly reaches the top portion **2*a* of the partition 2 to overflow into the storage chamber 4 along the path extending above the partition 2**.

The rate of continuous discharge of mixture through the outlet 17 of the storage chamber 4 is selected in such a way that the quantity of mixture leaving the chamber 4 per unit of time is less than the quantity overflowing the partition 2. When the rising supply of mixture in the chamber 4 reaches the level of the sensor 14, the latter transmits a signal which causes the circuit 20 to shut the regulating valve 21 and to arrest the pump 7 after a preselected interval of time. Such interval is selected with a view to ensure that the supply of mixture in the chamber 4 has reached the level of the float 16. The float 16 pivots and/or otherwise moves the valving element or flap 15 so as to expose the opening **2*b* and to thus establish a path for the flow of mixture from the lower portion of the chamber 3 directly into the adjacent portion of the chamber 4 or vice versa. It takes a relatively short interval of time until the opening 2*b* ensures that the level of the upper side of the supply of mixture in the chamber 3 matches the level of the upper side of the supply of mixture in the chamber 4**.

The mixture is continuously discharged from the chamber 4 through the outlet 17 and, therefore, the level of the mixture drops in the chamber 3 as well as in the chamber 4. When the level drops below that of the flap 15, the float 16 causes the flap to seal the opening **2*b*, i.e., the contents of the chamber 3 are again separated from the contents of the chamber 4. As the supply of mixture in the chamber 4 continues to decrease and the upper side of such supply descends below the sensor 14, the latter transmits a signal to the circuit 20** and the aforedescribed sequence of steps is repeated.

FIG. 1 shows that the flap 15 and the opening **2*b* are located at a level slightly above the bottom wall 5 of the chamber 3. This is desirable and advantageous because undissolved solid substances are less likely to enter the chamber 4 through the opening 2*b* and/or to gather on the flap 15 and/or on the partition 2 around the opening 2*b* which could result in unsatisfactory sealing of the opening 2*b* when the contents of the chambers 3 and 4 are to be separated from each other. On the other hand, placing of the opening 2*b* at a level above the bottom wall 5 prevents complete evacuation of the contents of the chamber 3. Since a float-operated valve is less sensitive than a magnetic valve, it is possible to lower the opening 2*b* closer toward or all the way to the upper side of the bottom wall 5. Alternatively, the vessel 1 can be provided with an additional opening (e.g., at the location pointed out in FIG. 1 by the arrow D) which can be exposed and sealed by a remotely controlled valve or in any other suitable way in order to permit complete evacuation of the contents of the chamber 3**, e.g., for the purposes of periodic cleaning.

An important advantage of the improved apparatus is its compactness. Thus, a single vessel 1 suffices to provide a mixing chamber or tank 3 and a storage chamber or tank 4. This is desirable on the additional ground that the space requirements of the improved apparatus are less than those of many presently known apparatus. The improved compact apparatus is less expensive than conventional apparatus with discrete mixing and storage tanks.

Another important advantage of the improved apparatus is that the chambers 3 and 4 are readily accessible from above for inspection, for admission of one or more substances and/or for the purposes of cleaning. Furthermore, the partition 2 between the chambers 3 and 4 serves the additional purpose of establishing a path for the overflow of mixture from the chamber 3 into the chamber 4.

The capacity of the storage chamber 4 below the opening **2*b* in the partition 2 is preferably selected in such a way that this portion of the chamber 4 can store a quantity of mixture which suffices to meet the requirements of the consuming machine or machines during the interval which elapses to complete the next-following making of a fresh mixture in the chamber 3. This is achieved by the simple expedient of locating the bottom wall 6 of the storage chamber 4 at a level sufficiently below that of the bottom wall 5 forming part of the mixing chamber 3. As already explained above, the making of a fresh mixture can begin in automatic response to descent of the supply of mixture in the tank or chamber 4 below the level of the sensor 14**.

The placing of the inlet 8 at a level above the bottom wall 5 of the mixing chamber 3 exhibits the advantage that the pump 7 is less likely to draw solid substances from the bottom portion of the chamber 3 when the pump is in the process of circulating liquid from the inlet 8, through the conduit 32, through the mixing nozzle 9 and back into the chamber 3. Were solid substances permitted to enter the pump 7 (or if the pump were to draw large quantities of solid substances), they would be likely to adversely affect the operation of the pump.

The provision of the container 18 exhibits the advantage that it prolongs the interval which is available to the person or persons in charge to admit requisite quantities of solid substances into the mixing chamber 3 subsequent to sealing of the opening **2*b* by the flap 15 under the action of the float 16**.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for preparing and dispensing a liquid for the treatment of photosensitive materials, comprising:

a mixing chamber including means for making a mixture of at least one liquid substance with at least one second substance; a storage chamber adjacent to said mixing chamber and being separated from said mixing chamber by a partition, said storage chamber having an outlet for the mixture of said liquid and second substances, said chambers defining a first path for the overflow of mixture above said partition from said mixing chamber into said storage chamber when the mixture in said mixing chamber rises to a first predetermined level; and a second path for the flow of mixture between said chambers when the mixture in said storage chamber rises to a second predetermined level.

2. The apparatus of claim 1, further comprising a valve being disposed in the second path.

3. The apparatus of claim 1, for continuously dispensing a liquid for the treatment of photosensitive materials, wherein said chambers include a common partition having a top portion at said first level so that the mixture can overflow from the mixing chamber into the storage chamber when such mixture rises in said mixing chamber above the top portion of said partition.

4. The apparatus of claim 2, wherein said valve includes a float in said storage chamber and a valving element which is movable by said float and establishes said second path when the mixture in said storage chamber descends to said second level.

5. The apparatus of claim 1, wherein said chambers form part of a vessel having an internal partition disposed between said chambers.

6. The apparatus of claim 1, said mixing chamber includes a bottom wall in the region of said second level.

7. The apparatus of claim 1, further comprising means for delivering to said mixing chamber a metered quantity of said at least one liquid substance when the mixture in said mixing chamber descends below said second level, said storage chamber including a portion disposed below said second level and having a capacity which at least suffices to receive and store a quantity of mixture at least matching said predetermined quantity.

8. The apparatus of claim 5, wherein said mixing chamber comprises a bottom wall and said mixture making means includes means for circulating the mixture along a third path having an inlet disposed in said mixing chamber at a level above said bottom wall.

9. The apparatus of claim 8, wherein said circulating means includes a pump and said delivering means has an outlet disposed in said mixing chamber beneath said first level and close to said bottom wall.

10. The apparatus of claim 8, wherein said outlet of said delivering means is adjacent said inlet.

11. The apparatus of claim 10, wherein said outlet of said delivering means is disposed above said inlet.

12. The apparatus of claim 1, further comprising a mixture collecting chamber being disposed below said storage chamber, said storage chamber having a bottom wall above said mixture collecting container, said outlet being provided in said bottom wall.

13. The apparatus of claim 1, wherein said mixing and storage chambers respectively have first and second bottom walls disposed at different levels.

14. The apparatus of claim 13, wherein the bottom wall of said mixing chamber is located above the bottom wall of said storage chamber.

* * * * *